United States Patent [19]

Halm

[11] 4,080,078

[45] Mar. 21, 1978

[54] ADHESIVE DISPENSER

[75] Inventor: Hans Halm, Herne, Germany

[73] Assignee: Lingner & Fischer, GmbH, Germany

[21] Appl. No.: 699,681

[22] Filed: Jun. 25, 1976

[51] Int. Cl.[2] ..... B43K 5/16; B43K 24/02

[52] U.S. Cl. ..... 401/116; 401/213; 401/262

[58] Field of Search ..... 401/116, 258, 60, 261, 401/265, 202, 213, 262

[56] References Cited

U.S. PATENT DOCUMENTS

| | | | |
|---|---|---|---|
| 3,103,691 | 9/1963 | Stull | 401/213 |
| 3,797,946 | 3/1974 | Witzmann et al. | 401/116 |

FOREIGN PATENT DOCUMENTS

| | | | |
|---|---|---|---|
| 1,131,287 | 2/1957 | France | 401/259 |

*Primary Examiner*—Stephen C. Pellegrino
*Attorney, Agent, or Firm*—Jacobs & Jacobs

[57] ABSTRACT

A dispenser suitable for dispensing flowable liquid adhesive is provided which comprises a squeezable reservoir body closed at one end and having an opening at the other end, an elongated, cylindrical, narrow bore nozzle attached to the opening to form an outlet, the wall of the reservoir body being generally cylindrical at least at that portion which is adjacent the nozzle, the nozzle and the cylindrical portion having a common longitudinal axis, a groove inclined at an angle to the common axis in the cylindrical portion of the reservoir body adjacent the nozzle or in the nozzle, a control cap which is mountable on the reservoir body and over the nozzle so that the nozzle projects through a corresponding close-fitting hole on the control cap which is sized to receive the nozzle, the control cap having an external surface suitable for spreading liquid adhesive adjacent the hole through which the nozzle projects and a locating stud disposed on the lower portion of the control cap sized to fit into the groove.

4 Claims, 5 Drawing Figures

ADHESIVE DISPENSER

This invention relates to dispensers, suitable for dispensing flowable liquid adhesives.

When using adhesives, it is commonly necessary to apply the adhesive to the substrate in two quite different ways. Sometimes fairly large areas must be covered with adhesives, requiring some sort of spreading tool, and sometimes spots or drops or fine lines of adhesive must be applied, requiring a pointed application nozzle. This invention provides a dispenser capable of providing both of these facilities.

According to the present invention there is provided a dispenser, suitable for dispensing flowable liquid adhesives comprising:

a squeezable reservoir body having an outlet through an elongate, cylindrical, narrow bore nozzle, the wall of the reservoir body being generally cylindrical at least adjacent the nozzle, the nozzle and the cylindrical part of the reservoir body adjacent the nozzle having a common longitudinal axis, a groove, inclined at an angle to said common axis, being provided in the cylindrical part of the reservoir body adjacent the nt nozzle or in the nozzle, a control cap being mounted on the reservoir body with the nozzle projecting through a corresponding close fitting hole in the control cap, with a locating stud on the control cap projecting into the groove, the control cap being manually rotatable about said common axis within the limits set by the stud travelling in the groove as the control cap rotates, the control cap having an external surface, suitable for spreading the contents of the reservoir body, adjacent the hole through which the nozzle projects, the distance, parallel to said common axis, between the stud and the spreading surface being substantially equal to the distance, parallel to said common axis, between the nozzle outlet and the end of said groove nearest the nozzle outlet.

Usually, the dispenser will be equipped with a removable and replaceable plug or cap to seal the nozzle, and this plug or cap may be held captive to the control cap by a flexible tie.

In a preferred embodiment of the invention, as the control cap is rotated so that the locating stud approaches the end of the groove nearest the nozzle outlet, the external spreading surface of the control cap forces the cap or plug from the nozzle to unseal the nozzle.

These and other features of the invention will now be particularly described with reference to the accompanying Drawings wherein.

Figure 1:
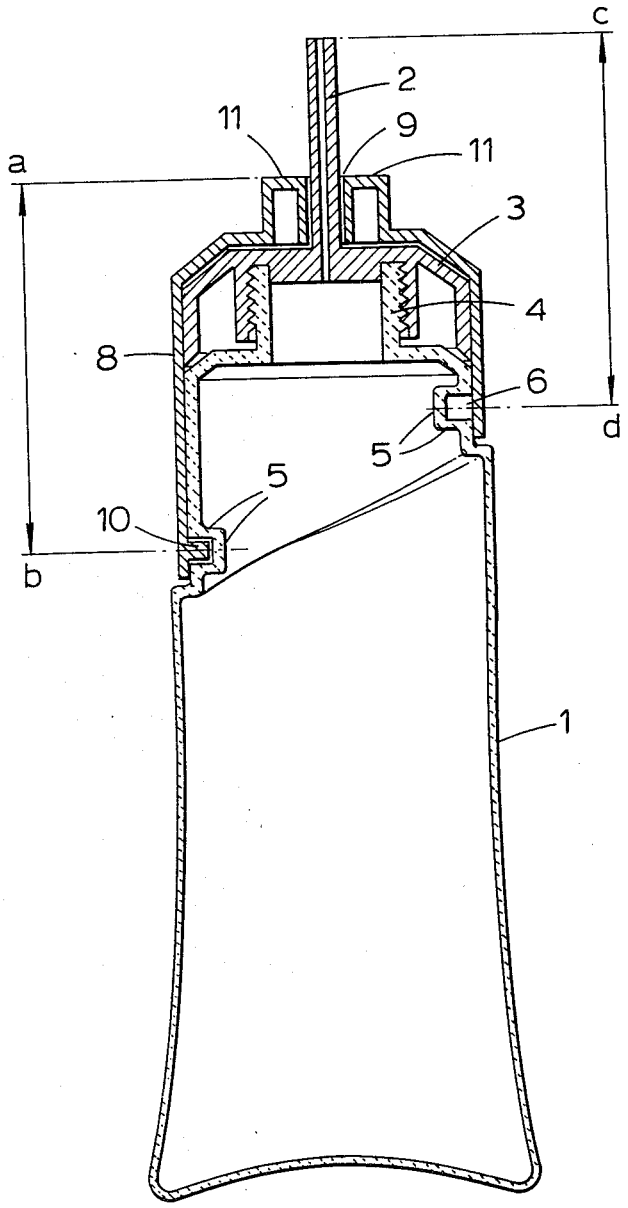
FIG. 1 is a cross-sectional view of a dispenser in accordance with this invention through its nozzle axis and with the control cap in the point application mode.

Referring to FIGS. 1–4 of the Drawings, a dispenser in accordance with the present invention comprises a bottle shaped reservoir body 1, constructed of a squeezable material such as polyethylene, having an outlet through an elongate cylindrical narrow bore nozzle 2. The nozzle 2 is formed as part of a nozzle unit 3 which is internally screw-threaded and mounted on the external screw threads of a neck portion 4 of the reservoir body 1, the wall of the reservoir body is generally cylindrical (best seen in FIG. 4) adjacent the nozzle end and is splayed at its base to provide free-standing stability. The nozzle and the cylindrical upper end of the reservoir body have a common longitudinal axis (which, in the embodiment shown is also the longitudinal axis of the entire dispenser).

A groove 5 (FIGS. 3 and 4) is recessed into the upper cylindrical part of the reservoir body. The groove is inclined at an angle to the common longitudinal axis of the nozzle and the reservoir body, and terminates at upper and lower stop surfaces 6 and 7.

A control cap 8 is mounted on the reservoir body with the nozzle 2 projecting (FIG. 1) through a closely fitting hole 9 in the control cap. A locating stud 10 projects into the groove 5 and the control cap is manually rotatable, about the common longitudinal axis of the nozzle and the reservoir body, from the position shown in FIG. 1 to the position shown in FIG. 2, within the limits set by the movement of the stud 10 in the groove 5. In practice this means that as the control cap is rotated from the position of FIG. 1, with the stud seated against the lower stop surface 7 of the groove 5, a camming action is exerted on the stud by the groove and the control cap is forced upwards along the longitudinal axis of the nozzle, until the stud finally seats against stop surface 6 of the groove (FIG. 2). If desired, a notch (not shown) could be provided in the reservoir body wall adjacent stop surface 6 to receive the stud 10 and render the control cap stable in the position of FIG. 2.

The control cap 8 has a surface 11 adjacent the hole 9 which may be used to spread the contents of the reservoir body in the following manner: With the control cap in the position of FIG. 2, the dispenser is inverted or tilted and some of the contents of the reservoir body are squeezed through the bore of the nozzle 2.

These contents emerge from the nozzle outlet and flow onto surface 11 which can then be rubbed over the work area. Intermittent squeezing of the reservoir body as the surface 11 is rubbed over the work area delivers more of the contents to the surface and the spreading operation continues. FIG. 2 thus shows the dispenser in its spreading mode.

Figure 2:
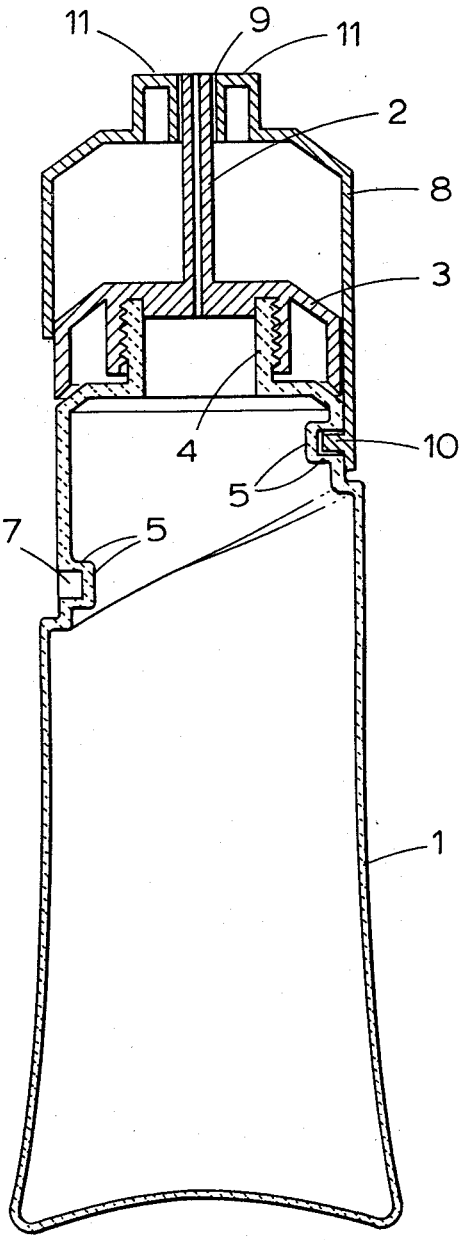
FIG. 2 is the same cross-sectional view as in FIG. 1 except that the control cap of the dispenser has been rotated to the spreading application mode.
Figure 3:
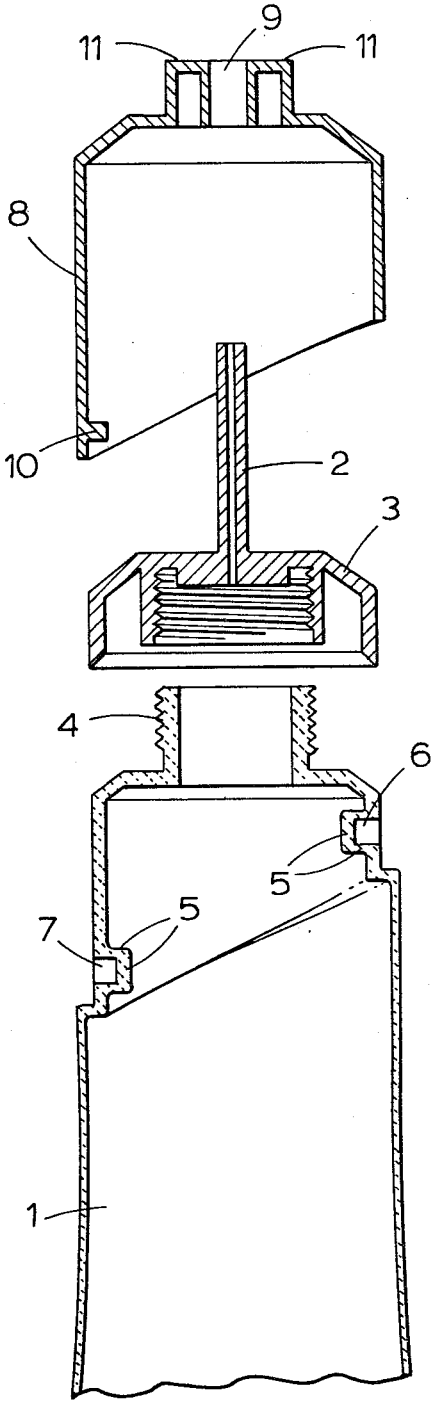
FIG. 3 is an exploded cross-sectional view through the nozzle axis of the dispenser shown in FIGS. 1 and 2.
Figure 4:
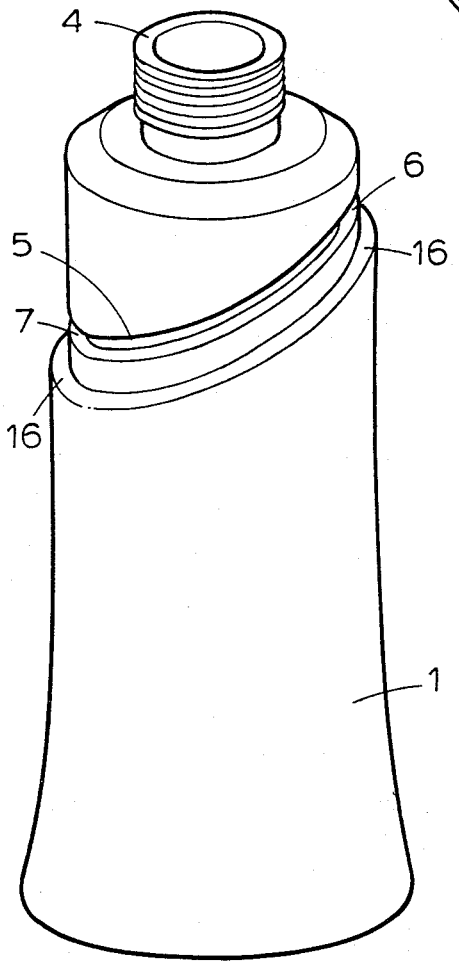
FIG. 4 is a perspective elevation view of the reservoir body of the device shown in FIGS. 1–3, showing more clearly the groove provided in the reservoir body wall.

In contrast, when the control cap is in the position of FIG. 1, the surface 11 is retracted from the nozzle outlet which can then be used to deliver small quantities of the contents of the reservoir body of the workpiece, e.g. as fine lines of threads or as drops. FIG. 1 thus shows the dispenser in the point application mode.

It will be apparent that in order for the nozzle outlet and surface 11 to co-operate in the spreading mode (FIG. 2) the distance, parallel to the common axis of the nozzle and reservoir body, between the stud 10 and the surface 11 (distance *a–b*) must be substantially equal to the corresponding distance (*c–d*) between the nozzle outlet and the end of the groove nearest the nozzle outlet, (see FIG. 1).

Figure 5:
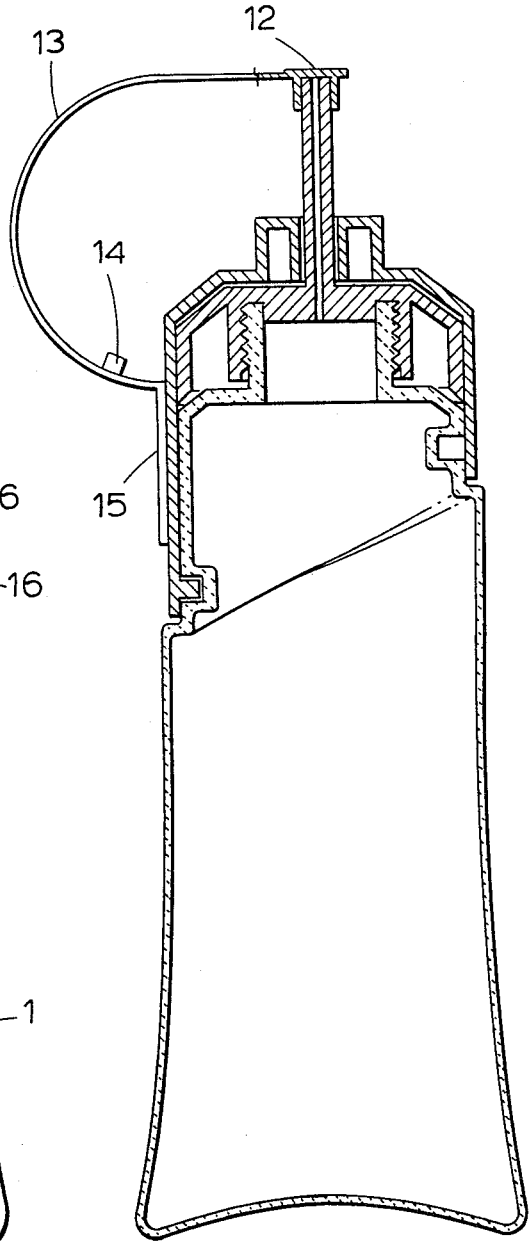
FIG. 5 is the same as FIG. 1 except that a captive cap for sealing the nozzle is shown.

Referring now to FIG. 5, a sealing cap 12 is mounted on the nozzle outlet and is held captive to the control cap by means of a flexible tie 13. The tie carries a stud 14 which can be forced into the cap 12 when it is removed from the nozzle outlet, thereby holding the cap out of the way while the dispenser is used. If desired two parallel ribs (one of which is shown as 15 in FIG. 5) may be provided on the control cap, spaced at a distance equal to the width of the flexible tie 13 so that the tie can be bent back and forced between the ribs. The ribs then grip the tie and hold it securely away from the nozzle outlet. It will be seen by comparing FIGS. 2 and 5 that as the control cap is rotated to its spreading mode, the spreading surface 11 will force the sealing cap 12 off the nozzle outlet, thereby unsealing the nozzle. This facility can be of great value if adhesive from a previous usage of the dispenser has glued the cap in position on the nozzle. Considerable force would, in such a case, have to be exerted to pull the sealing cap off manually, and small children might find this difficult and messy. However, by turning the control cap, the required force is automatically and easily applied. To assist in the turning of the control cap, its external surface might be ribbed or otherwise contoured to provide a good finger grip.

In the embodiment shown in the Drawings, the dispenser is given a smooth contour by the provision of narrow shoulder 16 (FIG. 4) which steps the reservoir body and provides a seat for the base of the control cap 8. This shoulder is shown as slanting at an angle to the longitudinal axis of the reservoir body, but this is not important; it could equally well be parallel to the base, with the control cap being correspondingly symmetrical.

What we claim is:

1. A dispenser suitable for dispensing flowable liquid adhesives which comprises:

(a) a squeezable reservoir body closed at one and having an opening at the other end;

(b) an elongated, cylindrical narrow bore nozzle attached to said opening to form an outlet, the wall of the reservoir body being generally cylindrical at least at that portion which is adjacent the nozzle, said nozzle and said cylindrical portion having a common longitudinal axis;

(c) a groove, inclined at an angle to said common axis in the cylindrical portion of the reservoir body adjacent the nozzle or in the nozzle;

(d) a control cap mountable on the reservoir body and over the nozzle so that the nozzle slidably projects through a corresponding close fitting hole in the control cap sized to receive the nozzle and thereby provides a wiping action of the nozzle upon rotation of the control cap, said control cap having an external surface suitable for spreading liquid adhesive adjacent the hole through which the nozzle projects; and (e) a locating stud disposed on the lower portion of the control cap sized to fit into said groove, the control cap being manually rotatable about said common axis within the limits set by the stud travelling in the groove as the control cap is rotated;

whereby the distance, parallel to said common axis, between the stud and the spreading surface is substantially equal to the distance, parallel to said common axis between the outlet end of the nozzle and that portion of the groove nearest said outlet end.

2. A dispenser according to claim 1 which further comprises a cap or plug which removably fits the outlet end of the nozzle.

3. A dispenser according to claim 2 wherein said cap or plug comprises a displaceable sealing cap which fits over and seals the outlet end of the nozzle and which is attached to one end of a flexible tie having a stud thereon over which said sealing cap is adapted to fit, the other end of said tie being affixed to the control cap.

4. A dispenser according to claim 3 wherein said flexible tie where it is affixed to the control cap is constructed and arranged so that said tie upon turning the control cap will force the sealing cap off the outlet end of the nozzle, thereby unsealing the nozzle and holding the sealing cap away from the nozzle outlet.

* * * * *